US011247871B2

(12) United States Patent
Guilani

(10) Patent No.: US 11,247,871 B2
(45) Date of Patent: Feb. 15, 2022

(54) ELEVATOR SYSTEM BELT

(71) Applicant: OTIS ELEVATOR COMPANY, Farmington, CT (US)

(72) Inventor: Brad Guilani, Woodstock Valley, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 404 days.

(21) Appl. No.: 16/188,414

(22) Filed: Nov. 13, 2018

(65) Prior Publication Data

US 2019/0144241 A1 May 16, 2019

Related U.S. Application Data

(60) Provisional application No. 62/584,483, filed on Nov. 10, 2017.

(51) Int. Cl.
*B66B 7/06* (2006.01)
*B66B 9/00* (2006.01)
(Continued)

(52) U.S. Cl.
CPC ..... *B66B 7/062* (2013.01); *B66B 9/00* (2013.01); *D07B 1/005* (2013.01); *D07B 1/162* (2013.01);
(Continued)

(58) Field of Classification Search
CPC ..... B66B 7/062; B66B 9/00; D07B 1/005; D07B 1/162; D07B 2205/30; D07B 2501/2007
See application file for complete search history.

(56) References Cited

U.S. PATENT DOCUMENTS 5,119,927 A * 6/1992 Bruggemann ..... B65G 15/34 198/846
7,168,231 B1 * 1/2007 Chou ..... D02G 3/443 57/210
(Continued)

FOREIGN PATENT DOCUMENTS

CN 202389881 U 8/2012
CN 202389882 U 8/2012
(Continued)

OTHER PUBLICATIONS

European Search Report Issued In EP Application No. 18205514.5, dated Mar. 27, 2019, 11 Pages.
(Continued)

*Primary Examiner* — Michael A Riegelman
(74) *Attorney, Agent, or Firm* — Cantor Colburn LLP

(57) ABSTRACT

A belt for an elevator system includes a plurality of tension members arranged along a belt width and extending longitudinally along a length of the belt. Each tension member includes a plurality of basalt fibers to enhance temperature resistance of the tension member. A jacket material at least partially encapsulates the plurality of tension members. An elevator system includes a hoistway, an elevator car located in the hoistway and movable therein, and a belt operably connected to the elevator car to suspend and/or drive the elevator car along the hoistway. The belt includes a plurality of tension members arranged along a belt width and extending longitudinally along a length of the belt. Each tension member includes a plurality of basalt fibers to enhance temperature resistance of the tension member. A jacket material at least partially encapsulates the plurality of tension members.

6 Claims, 4 Drawing Sheets

(51) Int. Cl.
*D07B 1/00* (2006.01)
*D07B 1/16* (2006.01)

(52) U.S. Cl.
CPC .. *D07B 2205/30* (2013.01); *D07B 2501/2007* (2013.01)

(56) References Cited

U.S. PATENT DOCUMENTS

| | | | | |
|---|---|---|---|---|
| 8,479,887 | B2 * | 7/2013 | Yu | B66B 23/24 187/251 |
| 9,051,651 | B2 * | 6/2015 | Veronesi | D07B 1/0666 |
| 9,670,035 | B2 | 6/2017 | Orelup et al. | |
| 10,676,319 | B2 | 6/2020 | Gurvich et al. | |
| 2011/0259677 | A1 * | 10/2011 | Dudde | D07B 1/145 187/411 |
| 2012/0329591 | A1 * | 12/2012 | Goeser | D07B 1/165 474/238 |
| 2013/0171463 | A1 * | 7/2013 | Chang | B66B 7/06 428/549 |
| 2014/0004298 | A1 * | 1/2014 | Reif | B29D 29/00 428/113 |
| 2014/0027211 | A1 * | 1/2014 | Wesson | B66B 7/06 187/414 |
| 2014/0243134 | A1 * | 8/2014 | Kucharczyk | C08J 5/24 474/261 |
| 2015/0191331 | A1 * | 7/2015 | Orelup | D07B 5/00 428/76 |
| 2015/0259176 | A1 * | 9/2015 | Goeser | B32B 3/18 428/189 |
| 2016/0060077 | A1 * | 3/2016 | Haapaniemi | B66B 11/08 187/255 |
| 2016/0325966 | A1 * | 11/2016 | Papas | B66B 7/062 |
| 2017/0043979 | A1 * | 2/2017 | Kucharczyk | B66B 7/062 |
| 2017/0066629 | A1 * | 3/2017 | Zhao | B66B 7/062 |
| 2017/0284503 | A1 * | 10/2017 | Goser | F16G 1/08 |
| 2018/0186604 | A1 * | 7/2018 | Helenius | D07B 1/165 |
| 2018/0305179 | A1 * | 10/2018 | Guilani | F16G 5/14 |
| 2019/0168999 | A1 * | 6/2019 | Guilani | B66B 7/062 |
| 2019/0218061 | A1 * | 7/2019 | Eastman | D07B 1/22 |
| 2019/0241401 | A1 * | 8/2019 | Davis | B66B 7/068 |
| 2020/0122971 | A1 * | 4/2020 | Hida | D07B 1/22 |
| 2020/0199814 | A1 * | 6/2020 | Wendeler-Goggelmann | D07B 1/06 |

FOREIGN PATENT DOCUMENTS

| | | | |
|---|---|---|---|
| CN | 202575214 | U | 12/2012 |
| CN | 104973480 | A | 10/2015 |
| CN | 204777121 | U | 11/2015 |
| CN | 105672009 | A | 6/2016 |
| CN | 105692389 | A | 6/2016 |
| CN | 105821561 | A | 8/2016 |
| CN | 205636323 | U | 10/2016 |
| CN | 106526768 | A | 3/2017 |
| EP | 3392183 | A1 | 10/2018 |
| EP | 3392185 | A1 | 10/2018 |
| WO | 2010072690 | A1 | 7/2010 |

OTHER PUBLICATIONS

First Examination Report; India Application No. 201814041135; dated Mar. 24, 2021; 5 pages.

* cited by examiner

- Prior Art -

ELEVATOR SYSTEM BELT

CROSS-REFERENCE TO RELATED APPLICATIONS

This application claims the benefit of 62/584,483, filed Nov. 10, 2017, which is incorporated herein by reference in its entirety.

BACKGROUND

Embodiments disclosed herein relate to elevator systems, and more particularly to load bearing members to suspend and/or drive elevator cars of an elevator system.

Elevator systems are useful for carrying passengers, cargo, or both, between various levels in a building. Some elevators are traction based and utilize load bearing members such as belts for supporting the elevator car and achieving the desired movement and positioning of the elevator car.

Where a belt is used as a load bearing member, a plurality of tension members, or cords, are embedded in a common jacket. The jacket retains the cords in desired positions and provide a frictional load path. In an exemplary traction elevator system, a machine drives a traction sheave with which the belts interact to drive the elevator car along a hoistway. Belts typically utilize tension members formed from steel elements, but alternatively may utilize tension members formed from synthetic fibers or other materials, such as carbon fiber composites.

In a carbon fiber composite tension member, the members have good strength to weight characteristics, but typically have reduced high temperature performance compared to tension members formed from steel wires.

BRIEF DESCRIPTION

In one embodiment, a belt for an elevator system includes a plurality of tension members arranged along a belt width and extending longitudinally along a length of the belt. Each tension member includes a plurality of basalt fibers to enhance temperature resistance of the tension member. A jacket material at least partially encapsulates the plurality of tension members.

Additionally or alternatively, in this or other embodiments the plurality of tension members are formed from a plurality of dry basalt fibers.

Additionally or alternatively, in this or other embodiments a tension member of the plurality of tension members includes a cord, and a basalt fiber layer wrapped around the cord.

Additionally or alternatively, in this or other embodiments the cord is formed from a plurality of steel wires.

Additionally or alternatively, in this or other embodiments the cord is formed from plurality of glass fibers suspended in a thermoset matrix material.

Additionally or alternatively, in this or other embodiments the jacket material is configured to provide a UL94 fire-resistance rating of V0 or better.

In another embodiment, a belt for an elevator system includes a plurality of tension members arranged along a belt width and extending longitudinally along a length of the belt, and a fabric material formed at least partially from a plurality of basalt fibers. The fabric material at least partially envelopes the plurality of tension members to retain the plurality of tension members.

Additionally or alternatively, in this or other embodiments the plurality of tension members are a plurality of cords formed from a plurality of steel wires.

Additionally or alternatively, in this or other embodiments the plurality of tension members are formed from a plurality of carbon fibers and/or a plurality of glass fibers suspended in a thermoset matrix material.

Additionally or alternatively, in this or other embodiments the fabric material is a woven or braided fabric material.

Additionally or alternatively, in this or other embodiments a belt coating is applied to the fabric material to protect the fabric material from abrasion and/or wear.

In yet another embodiment, an elevator system includes a hoistway, an elevator car located in the hoistway and movable therein, and a belt operably connected to the elevator car to suspend and/or drive the elevator car along the hoistway. The belt includes a plurality of tension members arranged along a belt width and extending longitudinally along a length of the belt. Each tension member includes a plurality of basalt fibers to enhance temperature resistance of the tension member. A jacket material at least partially encapsulates the plurality of tension members.

Additionally or alternatively, in this or other embodiments the plurality of tension members are formed from a plurality of dry basalt fibers.

Additionally or alternatively, in this or other embodiments a tension member of the plurality of tension members includes a cord, and a basalt fiber layer wrapped around the cord.

Additionally or alternatively, in this or other embodiments the cord is formed from a plurality of steel wires.

Additionally or alternatively, in this or other embodiments the cord is formed from plurality of non-metallic fibers suspended in a thermoset matrix material.

Additionally or alternatively, in this or other embodiments the jacket material is configured to provide a UL94 fire-resistance rating of V0 or better.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

A detailed description of one or more embodiments of the disclosed apparatus and method are presented herein by way of exemplification and not limitation with reference to the Figures.

Figure 1:
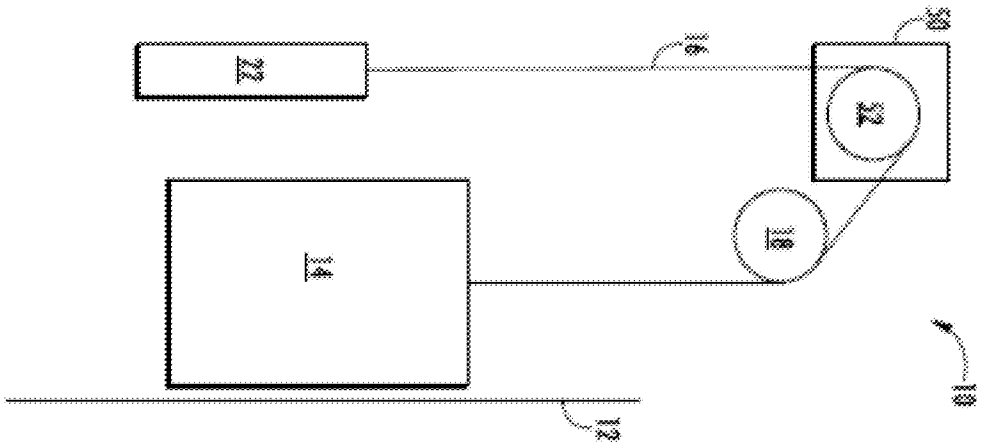
FIG. 1 is a schematic illustration of an embodiment of an elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter, which may be the same or different than the diameters of the other sheaves 18 in the elevator system 10. At least one of the sheaves could be a traction sheave 52. The traction sheave 52 is driven by a machine 50. Movement of drive sheave by the machine 50 drives, moves and/or propels (through traction) the one or more belts 16 that are routed around the traction sheave 52. At least one of the sheaves 18 could be a diverter, deflector or idler sheave. Diverter, deflector or idler sheaves are not driven by a machine 50, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 12 and counterweight 22, while other embodiments may utilize other roping arrangements.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

Figure 2:
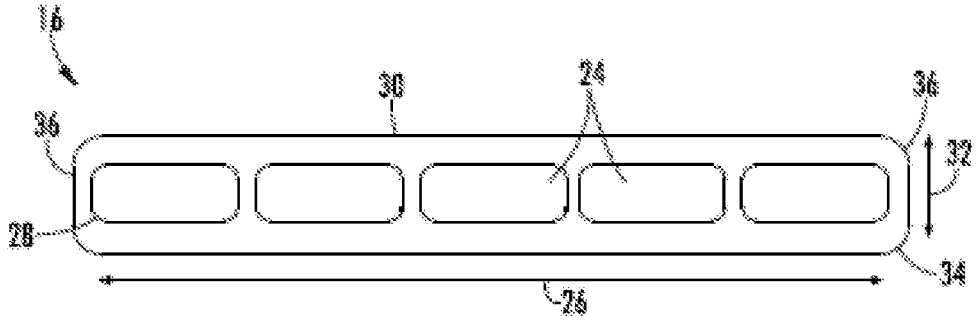
FIG. 2 is a schematic cross-sectional view of an embodiment of an elevator system belt.

FIG. 2 provides a cross-sectional schematic of an exemplary belt 16 construction or design. The belt 16 includes a plurality of tension members 24 extending longitudinally along the belt 16 and arranged across a belt width 26. The tension members 24 are at least partially enclosed in a jacket material 28 to restrain movement of the tension members 24 in the belt 16 and to protect the tension members 24. The jacket material 28 defines a traction side 30 configured to interact with a corresponding surface of the traction sheave 52. Exemplary materials for the jacket material 28 include the elastomers of thermoplastic and thermosetting polyurethanes, polyamide, thermoplastic polyester elastomers, and rubber, for example. Other materials may be used to form the jacket material 28 if they are adequate to meet the required functions of the belt 16. For example, a primary function of the jacket material 28 is to provide a sufficient coefficient of friction between the belt 16 and the traction sheave 52 to produce a desired amount of traction therebetween. The jacket material 28 should also transmit the traction loads to the tension members 24. In addition, the jacket material 28 should be wear resistant and protect the tension members 24 from impact damage, exposure to environmental factors, such as chemicals, for example. Further, the jacket material 28 may be formulated to provide a UL94 fire-resistance rating of V0 or better.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34. While five tension members 24 are illustrated in the embodiment of FIG. 2, other embodiments may include other numbers of tension members 24, for example, 4, 8, 10 or 12 tension members 24. Further, while the tension members 24 of the embodiment of FIG. 2 are substantially identical, in other embodiments, the tension members 24 may differ from one another.

Figure 3:
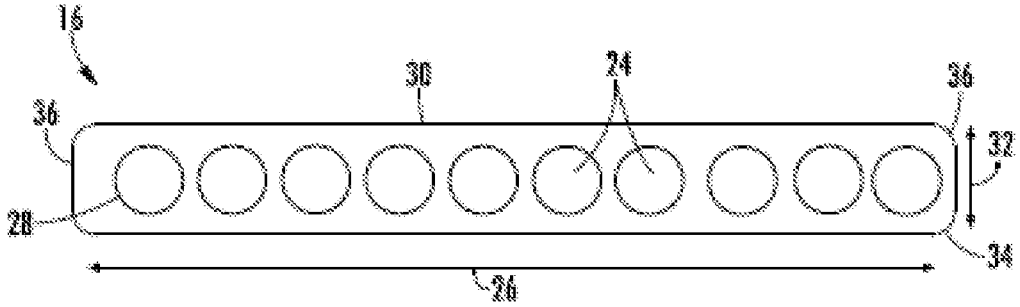
FIG. 3 is another cross-sectional view of an embodiment of an elevator system belt.

As shown in FIG. 2, the tension members 24 are formed from a plurality of dry basalt fibers. "Dry" in this disclosure meaning that the basalt fibers are not suspended in a thermoset matrix material as part of the tension member 24. A sizing material, such as siloxane, fluorocarbon, or the like may be utilized in construction of the tension members 24 to improve lubricity of the basalt fibers of the tension member 24. The sizing material may also be formulated from a combination of a polymeric binder, such as epoxy, phenolic, urethane, and/or acrylic, and an additive, such as fluorocarbons, inorganic oxides, borides, and/or metals. The aforementioned formulations of sizings are exemplary and other formulations described in prior art may be suitable to achieve lubricity of basalt fibers. While in the embodiment of FIG. 2, the tension members 24 have a rectangular cross-section, in other embodiments other cross-sectional shapes may be utilized. For example, in the embodiment of FIG. 3, the tension members 24 have a circular cross-sectional shape. It is to be appreciated that the cross-sectional shapes shown in FIGS. 2 and 3 are merely exemplary and that still other shapes may be utilized. Utilizing basalt fibers improves high temperature performance of the tension members 16 when compared to tension members of carbon fiber or glass fiber, a performance which is further improved with the use of a fire-resistant jacket material 28.

Figure 4:
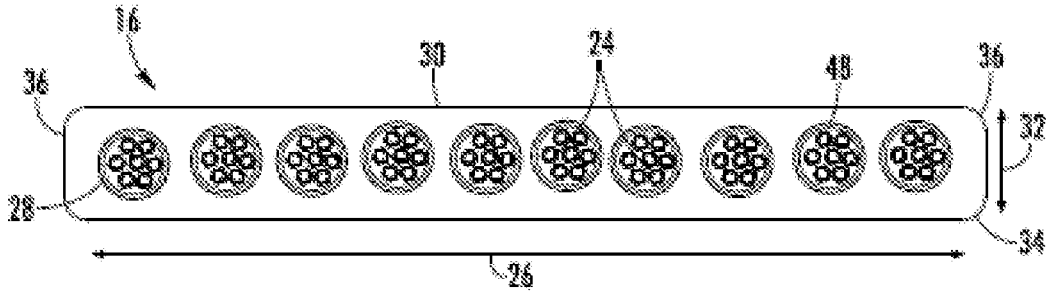
FIG. 4 is yet another cross-sectional view of an embodiment of an elevator system belt.
Figure 4A:
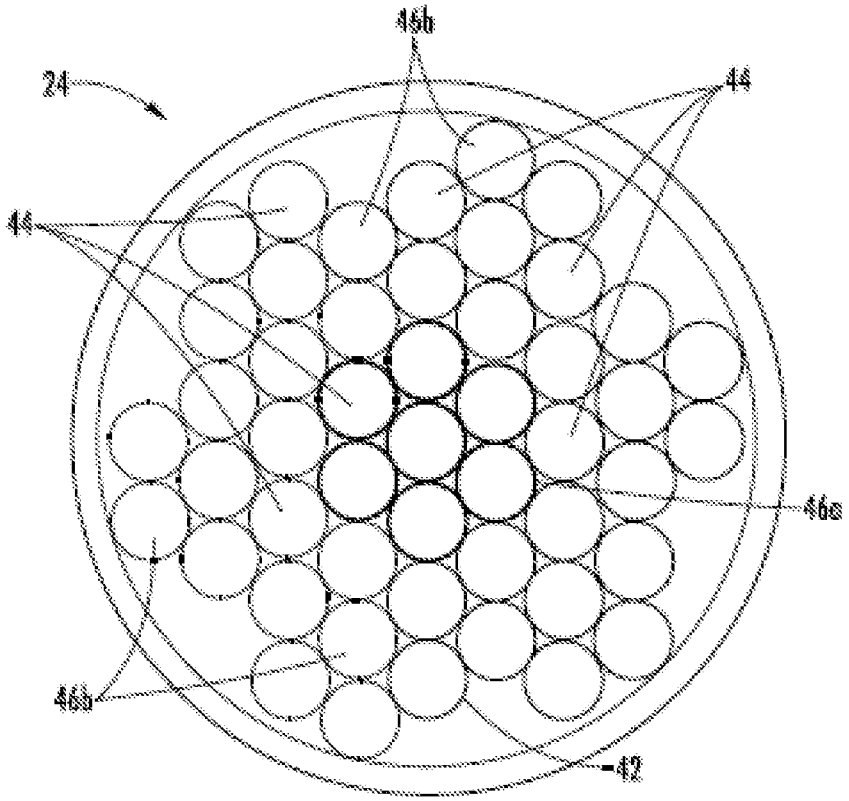
FIG. 4A is a cross-sectional view of an embodiment of a cord for an elevator system belt.

Referring now to FIG. 4, another embodiment of a belt 16 is illustrated. In the embodiment of FIG. 4 and shown best in FIG. 4A, the tension members 24 include cords 42 formed from a plurality of wires 44, for example, steel wires 44, formed into a plurality of strands 46, which are in turn formed into the cords 42. In some embodiments, each cord 42 has a center strand 46*a* and a plurality of outer strands 46*b* arranged around the center strand 46*a*.

Figure 5:
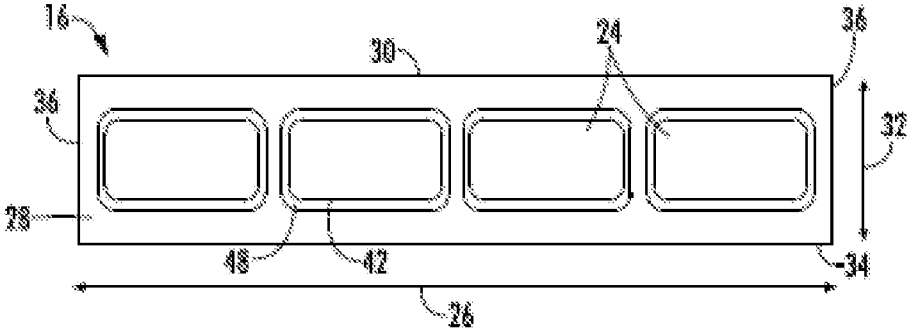
FIG. 5 is another cross-sectional view of an embodiment of an elevator system belt.

The tension members 24 are wrapped in a basalt fiber layer 48 disposed between the cord 42 and the jacket material 28, to improve fire resistance of the belt 16. Further, referring to FIG. 5, the basalt fiber layer 48 may be utilized in a belt 16 having a tension member 24 formed from other materials, such as glass fibers or other non-metallic fibers suspended in a thermoset matrix material.

Figure 6:
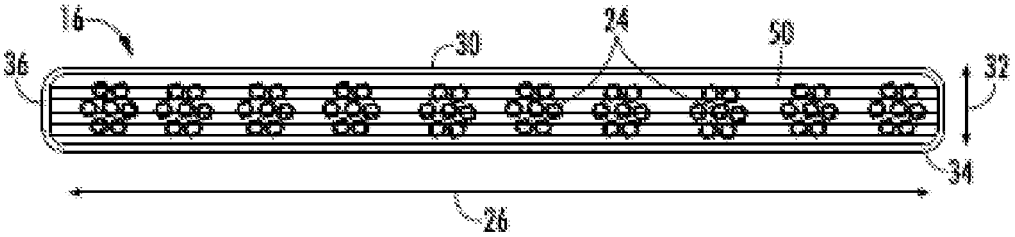
FIG. 6 is yet another cross-sectional view of an embodiment of an elevator system belt.

In another embodiment, as shown in FIG. 6, basalt fibers may be utilized in a woven belt 16. In the embodiment shown, the belt 16 includes a plurality of tension members 24, retained in a fabric 50 formed from basalt fibers to provide fire resistance for the belt 16. In some embodiments the tension members 24 are formed from a plurality of steel wires, while in other embodiments the tension members 24 may be formed from, for example, glass fibers suspended in a thermoset matrix material. The fabric 50 is formed from basalt fibers that are, for example, braided or woven around the tension members 24 to retain the tension members 24. A belt coating 52 is applied to the belt 16 to protect the fabric 50 from abrasion and wear.

Use of basalt fibers in the construction of belt 16, either as a tension member 24 material, a wrap layer for a tension member 24 or a fabric 50 fiber improves high temperature performance of the belt 16.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A belt for an elevator system, comprising:

a plurality of tension members arranged along a belt width and extending longitudinally along a length of the belt, each tension member including a plurality of basalt fibers to enhance temperature resistance of the tension member; and a jacket material at least partially encapsulating the plurality of tension members;

wherein a tension member of the plurality of tension members includes:

a cord; and a basalt fiber layer wrapped around the cord; and wherein the cord is formed from a plurality of steel wires formed into a plurality of strands which are formed into the cord.

2. The belt of claim 1, wherein the plurality of tension members are formed from a plurality of dry basalt fibers.

3. The belt of claim 1, wherein the jacket material is configured to provide a UL94 fire-resistance rating of V0 or better.

4. An elevator system, comprising:

a hoistway;

an elevator car disposed in the hoistway and movable therein;

a belt operably connected to the elevator car to suspend and/or drive the elevator car along the hoistway, the belt including:

a plurality of tension members arranged along a belt width and extending longitudinally along a length of the belt, each tension member including a plurality of basalt fibers to enhance temperature resistance of the tension member; and a jacket material at least partially encapsulating the plurality of tension members;

wherein a tension member of the plurality of tension members includes:

a cord; and a basalt fiber layer wrapped around the cord; and wherein the cord is formed from a plurality of steel wires formed into a plurality of strands which are formed into the cord.

5. The elevator system of claim 4, wherein the plurality of tension members are formed from a plurality of dry basalt fibers.

6. The elevator system of claim 4, wherein the jacket material is configured to provide a UL94 fire-resistance rating of V0 or better.

* * * * *